US011597990B2

(12) United States Patent
Diez et al.

(10) Patent No.: US 11,597,990 B2
(45) **Date of Patent: *Mar. 7, 2023**

(54) PROCESS FOR MANUFACTURING A COATED METAL STRIP OF IMPROVED APPEARANCE

(71) Applicant: ArcelorMittal, Luxembourg (LU)

(72) Inventors: Luc Diez, Metz (FR); Jean-Michel Mataigne, Senlis (FR); Bertrand Orsal, Vineuil-Saint-Firmin (FR); Hubert Saint Raymond, Metz (FR)

(73) Assignee: ArcelorMittal, Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 17/323,235

(22) Filed: May 18, 2021

(65) Prior Publication Data

US 2021/0269907 A1 Sep. 2, 2021

Related U.S. Application Data

(60) Continuation of application No. 16/856,232, filed on Apr. 23, 2020, which is a continuation of application No. 16/004,131, filed on Jun. 8, 2018, now Pat. No. 10,724,130, which is a division of application No. 13/121,833, filed as application No. (Continued)

(30) Foreign Application Priority Data

May 14, 2009 (WO) ..... PCT/FR2009/000562

(51) Int. Cl.
*C23C 2/20* (2006.01)
*C23C 2/06* (2006.01)
*C23C 2/16* (2006.01)

(52) U.S. Cl.
CPC ..... *C23C 2/20* (2013.01); *C23C 2/06* (2013.01); *C23C 2/16* (2013.01)

(58) Field of Classification Search
CPC ..... C23C 2/20
See application file for complete search history.

(56) References Cited

U.S. PATENT DOCUMENTS 3,607,366 A 9/1971 Kurokawa et al.
3,802,911 A 4/1974 La Camera et al.
(Continued)

FOREIGN PATENT DOCUMENTS

EP 0038904 A1 11/1981
EP 0122856 A1 10/1984
(Continued)

*Primary Examiner* — David P Turocy
(74) *Attorney, Agent, or Firm* — Davidson, Davidson & Kappel, LLC

(57) ABSTRACT

An installation for continuous hot-dip coating of a metal strip is provided. The installation includes a tank containing a bath of molten metal, a metal strip running through the bath and a confined wiping device. The confined wiping device includes at least two wiping nozzles placed on each side of a path of the strip after the strip has left the bath of molten metal. Each nozzle has at least one gas outlet orifice and an upper face. The confined wiping device also includes a confinement box adjacent each upper face. The confinement boxes are open on a face which faces the strip. Each box includes at least one upper part and two lateral parts.

26 Claims, 5 Drawing Sheets

Related U.S. Application Data

PCT/FR2010/000364 on May 11, 2010, now abandoned.

(56) References Cited

U.S. PATENT DOCUMENTS

| | | | | |
|---|---|---|---|---|
| 4,346,129 | A | 8/1982 | Decker et al. | |
| 4,369,211 | A | 1/1983 | Nitto et al. | |
| 4,557,952 | A | 12/1985 | Mitch et al. | |
| 4,557,953 | A | 12/1985 | Boston et al. | |
| 4,612,215 | A | 9/1986 | Hennechart et al. | |
| 6,235,410 | B1 | 5/2001 | Komatsu et al. | |
| 6,379,820 | B1 | 4/2002 | Komatsu et al. | |
| 6,503,323 | B1 | 1/2003 | El-Becha et al. | |
| 6,752,870 | B1 | 6/2004 | Tanokuchi et al. | |
| 9,181,614 | B2 | 11/2015 | Diez et al. | |
| 9,598,756 | B2 | 3/2017 | Oohashi et al. | |
| 2004/0050323 | A1* | 3/2004 | Chae | C23C 2/20 118/400 |
| 2011/0111255 | A1 | 5/2011 | Diez et al. | |
| 2011/0177253 | A1* | 7/2011 | Oohashi | C23C 2/06 427/432 |

FOREIGN PATENT DOCUMENTS

| | | | | | |
|---|---|---|---|---|---|
| EP | 0905270 | A2 | | 3/1999 | |
| EP | 1077269 | A2 | | 2/2001 | |
| GB | 1602731 | A | * | 11/1981 | B05C 11/06 |
| GB | 1602731 | A | | 11/1981 | |
| JP | S5022723 | A | | 3/1975 | |
| JP | S5022723 | B2 | * | 8/1975 | |
| JP | H11140615 | A | | 5/1999 | |
| JP | 2002-348651 | A | | 12/2002 | |
| JP | 2008-095129 | A | | 4/2008 | |
| JP | 2008095129 | A | * | 4/2008 | |
| RU | 2128715 | C1 | | 4/1999 | |
| WO | 2010038472 | A1 | | 4/2010 | |
| WO | 2010130883 | A1 | | 11/2010 | |

* cited by examiner

PROCESS FOR MANUFACTURING A COATED METAL STRIP OF IMPROVED APPEARANCE

CROSS REFERENCE TO RELATED APPLICATIONS

This is a continuation of U.S. patent application Ser. No. 16/856,232, filed on Apr. 23, 2020 which is a Continuation of U.S. patent application Ser. No. 16/004,131, filed Jun. 8, 2018, which issued on Jul. 28, 2020 as U.S. Pat. No. 10,724,130 which is a divisional of U.S. application Ser. No. 13/121,833 filed on Aug. 5, 2011 which is a national stage of PCT/FR2010/000364 filed on May 11, 2010 which claims priority to PCT/FR2009/000562 filed on May 14, 2009, the entire disclosures of which are hereby incorporated by reference herein.

The invention relates to a process for manufacturing a metal strip of improved appearance, more particularly one intended to be used for the manufacture of shell parts for terrestrial motor vehicles, without however being limited thereto.

BACKGROUND

Steel sheet intended for the manufacture of parts for a terrestrial motor vehicle is generally coated with a zinc-based metal layer for corrosion protection, deposited either by hot-dip coating in a zinc-based liquid bath or by electrodeposition in an electroplating bath containing zinc ions.

Galvanized sheet intended for the manufacture of shell parts then undergoes a forming operation and is assembled to form a body-in-white, which is then coated with at least one coat of paint, thereby providing greater corrosion protection and an attractive surface appearance.

For this purpose, conventionally, automobile manufacturers firstly apply a cataphoretic coating to the body-in-white, followed by a primer coat of paint, a base coat of paint and optionally a varnish coat. To obtain a satisfactory painted surface appearance, it is general practice to apply a total paint thickness of between 90 and 120 μm, consisting of a cataphoretic coating 20 to 30 μm in thickness, a primer coat of paint 40 to 50 μm in thickness and a base coat of paint 30 to 40 μm in thickness, for example.

To reduce the thickness of paint systems to less than 90 μm, certain automobile manufacturers have proposed either to dispense with the cataphoresis step or to reduce the number of coats of paint in order to increase productivity. However, at the present time, this thickness reduction of the paint system is always to the detriment of the final appearance of the painted surface of the part and is not implemented in industrial production.

The reason for this is that the surface of the zinc-based coatings serving as base substrate has what is called a "waviness" which, at the present time, can be compensated for only by thick coats of paint under penalty of having what is called an "orange peel" appearance, which is unacceptable for body parts.

The waviness W of the surface is a slight pseudoperiodic geometrical irregularity with quite a long wavelength (0.8 to 10 mm) which is distinguished from the roughness R, which corresponds to geometrical irregularities of shorter wavelengths (<0.8 mm).

SUMMARY OF THE INVENTION

In the present invention, the arithmetic mean Wa of the waviness profile, expressed in μm, is used to characterize the surface waviness of the sheet, and the waviness is measured with a 0.8 mm cutoff threshold denoted by $Wa_{0.8}$.

An object of the invention is therefore to provide a process for manufacturing a metal strip coated with a corrosion protection coating, the waviness $Wa_{0.8}$ of which is smaller than in strip of the prior art, thus making it possible to manufacture painted metal parts requiring a smaller total paint thickness compared with the parts of the prior art. Another object of the invention is to provide an installation for implementing such a process.

For this purpose, the present invention provides a process for manufacturing a metal strip having a metal coating for corrosion protection, comprising the steps of:

- making the metal strip pass through a bath of molten metal; then
- wiping the coated metal strip by means of nozzles that spray a gas on each side of the strip, said gas having an oxidizing power lower than that of an atmosphere consisting of 4% oxygen by volume and 96% nitrogen by volume; and then
- making the strip pass through a confinement zone bounded:
  - at the bottom, by the wiping line and the upper faces of said wiping nozzles,
  - at the top, by the upper part of two confinement boxes placed on each side of the strip, just above said nozzles, and having a height of at least 10 cm in relation to the wiping line and
  - on the sides, by the lateral parts of said confinement boxes, the atmosphere in said confinement zone having an oxidizing power lower than that of an atmosphere consisting of 4% oxygen by volume and 96% nitrogen by volume and higher than that of an atmosphere consisting of 0.15% oxygen by volume and 99.85% nitrogen by volume.

In preferred methods of implementation, the process to the invention may further include the following features, individually or in combination:

- the confinement boxes have a height of at least 15 cm, preferably 20 cm, even 30 cm, in relation to the wiping line;
- the confinement boxes are fed with a gas having an oxidizing power lower than that of an atmosphere consisting of 4% oxygen by volume and 96% nitrogen by volume, and preferably higher than that of an atmosphere consisting of 0.15% oxygen by volume and 99.85% nitrogen by volume;
- the wiping gas consists of nitrogen;
- the metal strip is a steel strip.

The present invention also provides an installation for the continuous hot-dip coating of metal strip, comprising:

- means for running a metal strip;
- a tank containing a bath of molten metal; and
- a confined wiping device consisting of at least two wiping nozzles placed on each side of the path of the strip after it has left the bath of molten metal, each nozzle being provided with at least one gas outlet orifice and comprising an upper face, which face is surmounted by a confinement box open on a face which faces the strip, each box comprising at least one upper part and two lateral parts.

In preferred embodiments, the installation according to the invention may further include the following features, individually or in combination:

- the upper parts of the confinement boxes consist of an end plate and an upper plate;

each of the confinement boxes is compartmentalized by a series of vertical blades extending from the upper face of the nozzle up to the upper part of the confinement boxes;

the distance D between the end of the lateral parts of the confinement boxes and the strip is between 10 and 100 mm;

the height H of the confinement boxes in relation to the wiping line is greater than or equal to 10 cm;

the confined wiping devices further include antinoise plates on each side of the strip, facing part of the outlet orifice of the wiping nozzles;

the confinement boxes further include edge confinement pieces placed between the confinement boxes above the antinoise plates, facing the edges of the strip;

the edge confinement pieces may be moved horizontally and vertically;

each of the edge confinement pieces consists of two rectangular plates parallel to the strip and are connected by a lateral plate placed facing the edges of the strip;

each of the edge confinement pieces consists of two rectangular plates inclined to the plane in which the strip runs and joined together along their vertical edge placed facing the edges of the strip;

the edge confinement pieces further include a return means connecting the rectangular plates, the rectangular plates being sufficiently inclined to the plane in which the strip runs in order to be in contact with the lateral parts of the confinement boxes;

the installation comprises edge confinement pieces placed between the confinement boxes, facing the edges of the strip and extending so as to face part of the outlet orifice of the wiping nozzles; and the wiping nozzles are provided with a single outlet orifice in the form of a longitudinal slot with a width at least equal to that of the strip to be coated.

A further subject of the invention is a confined wiping device as defined above.

The features and advantages of the present invention will become more clearly apparent over the course of the following description given by way of nonlimiting example.

Referring to FIG. 1, the first step of the process according to the invention consists in making a metal strip B, such as a steel strip, pass continuously through a coating bath 1 comprising molten metal contained in a tank 2. Before being dipped into this bath 1, the strip B generally undergoes an annealing operation in a furnace, especially for preparing the surface.

On industrial lines, the strip run speed is in general between, for example, 40 m/min and 200 m/min, preferably greater than 120 m/min or even greater than 150 m/min.

The composition of the coating bath to be used in the process according to the invention may especially be based on zinc or a zinc alloy, but also based on aluminum or an aluminum alloy. Both these elements protect the strip from corrosion.

The composition of the bath may also contain up to 0.3% by weight of optional addition elements such as Si, Sb, Pb, Ti, Ca, Mn, Sn, La, Ce, Cr, Ni, Zr or Bi. These various elements may make it possible, inter alia, to improve the corrosion resistance of the coating or its brittleness or its adhesion for example. A person skilled in the art knowing their effects on the characteristics of the coating will employ them in accordance with the intended complementary purpose. It has also been confirmed that these elements do not interfere with the waviness control obtained by the process according to the invention. Under certain circumstances, it will however be preferable to limit the titanium content to less than 0.01%, or even less than 0.005%, since this element may cause contamination problems in the degreasing and phosphating baths used by automobile manufacturers.

Finally, the bath may contain inevitable impurities coming from the ingots fed into the tank or else from the strip passing through the bath. Thus, these may include in particular iron, etc.

The bath is maintained at a temperature between the liquidus +10° C. and 750° C., the temperature of the liquidus varying depending on its composition. For the range of coatings used in the present invention, this temperature will therefore be between 350 and 750° C. It will be recalled that the liquidus is the temperature above which an alloy is entirely in the molten state.

After having passed through the tank 2, the metal strip B coated on both its faces then undergoes a wiping operation by means of nozzles 3 placed on each side of the strip B, which nozzles spray a wiping gas onto the surface of the strip B. This conventional operation, well known to those skilled in the art, enables the thickness of the coating, although it has not yet solidified, to be precisely adjusted.

One of the essential features of the process according to the invention consists in choosing a wiping gas having an oxidizing power lower than that of an atmosphere consisting of 4% oxygen by volume and 96% nitrogen by volume. In particular, it will be possible to use pure nitrogen or pure argon, or else mixtures of nitrogen or argon and oxidizing gases such as, for example, oxygen, $CO/CO_2$ mixtures or $H_2/H_2O$ mixtures. It will also be possible to use $CO/CO_2$ mixtures or $H_2/H_2O$ mixtures without the addition of an inert gas.

After the wiping step, the other essential feature of the process according to the invention is the passage through a confinement zone bounded:

at the bottom, by the wiping line L and the upper external faces of the wiping nozzles 3;

at the top, by the upper part of two confinement boxes C placed on each side of the strip, just above the nozzles 3, and having a height of at least 10 cm in relation to the wiping line L; and on the sides, by the lateral parts of the confinement boxes C, the atmosphere in the confinement zone having an oxidizing power lower than that of an atmosphere consisting of 4% oxygen by volume and 96% nitrogen by volume and higher than that of an atmosphere consisting of 0.15% oxygen by volume and 99.85% nitrogen by volume.

To determine the oxidizing power of the atmosphere surrounding the strip, its equivalent equilibrium oxygen partial pressure is evaluated.

When the only oxidizing gas present is $O_2$ mixed with an inert gas (nitrogen or argon), this pressure is then equal to the volume content of $O_2$ that can be measured in real time by means of a suitable sensor.

When other oxidizing gases, such as $H_2O$ or $CO_2$, are present mixed with a reducing gas such as for example $H_2$ or CO, the equivalent oxygen partial pressure is calculated by the law of mass action at the gas temperature in question.

For example, for the $H_2/H_2O$ pair, the reaction is expressed as follows:

$$H_2+\tfrac{1}{2}O_2 \leftrightarrow H_2O.$$

In thermodynamic equilibrium, the partial pressures of the gases obey the following equation:

$$\frac{pH_2O}{pH_2 \times \sqrt{pO_2}} = e^{-\frac{\Delta G}{RT}}$$

where R is the perfect gas constant, T is the gas temperature in kelvin and ΔG is the change in free energy associated with the reaction, which may be found in thermodynamic tables, in calories per mole or in joules per mole depending on the value taken for the constant R.

The value of $pO_2$, the equivalent equilibrium oxygen partial pressure for the gas mixture in question, is obtained from the above equation.

Within the context of the invention, it is necessary for $pO_2$ to be between 0.0015 and 0.04 in the confinement atmosphere.

The present inventors have in fact found that by using a wiping gas according to the invention and making the strip pass through such a confinement zone, surprisingly a coating having a waviness smaller than that of coated strip of the prior art is obtained.

Within the context of the present application, the term "wiping line" is understood to mean the shortest segment connecting the nozzle and the strip, corresponding to the minimum path followed by the wiping gas, as denoted by the letter L in FIG. 1.

The confinement boxes used in the process according to the invention may be supplied with gas having a low oxidizing power, or else an inert gas, or they may simply be supplied by the flow of wiping gas escaping from the nozzles.

The oxidizing power of the wiping gas is limited to that of a mixture consisting of 4% oxygen by volume and 96% nitrogen by volume, since above this degree of oxidation, the waviness of the coating is not improved over that of the prior art.

In contrast, a lower limit for the oxidizing power of the confinement atmosphere is imposed, set to the oxidizing power of a mixture consisting of 0.15% oxygen by volume and 99.85% nitrogen by volume, since if this confinement atmosphere is not oxidizing enough, its use will promote zinc vaporization from the not yet solidified coating, which vapor may then foul the confinement boxes and/or may be redeposited on the strip, thus creating unacceptable visible defects.

Although all kinds of wiping nozzles may be used to implement the process according to the invention, it is more particularly preferred to choose nozzles having a blade-shaped outlet orifice, the width of which exceeds that of the strip to be coated, since this type of nozzle enables the bottom part of the wiping zone to be properly confined. In particular, nozzles of triangular cross section, as especially shown schematically in FIG. 1, may advantageously be used. These nozzles are generally located 30 or even 40 cm above the surface of the bath.

By respecting these settings, a surprising and significant reduction in the waviness of the coatings in question is observed, as the trials presented below demonstrate.

When the coated strip has completely cooled, it may undergo a skin-pass operation enabling it to be given a texture facilitating its subsequent forming process. This is because the skin-pass operation gives the surface of the strip sufficient roughness in order for the forming process to be properly carried out thereon, by promoting good retention of the oil applied to the strip before it is formed.

This skin-pass operation is generally carried out for metal sheet intended for the manufacture of body parts for terrestrial motor vehicles. When the metal sheet according to the invention is intended for manufacturing household electrical appliances for example, this additional operation is not carried out.

The sheet, whether skin-passed or not, then undergoes a forming process, for example by drawing, bending or profiling, preferably by drawing, in order to form a part that can then be painted. In the case of parts for the household electrical field, this coat of paint may also be optionally baked by physical and/or chemical means known per se. For this purpose, the painted part may be passed through a hot-air or induction oven, or else pass beneath UV lamps or beneath an electron beam device.

For the production of automobile parts, the sheet is dipped into a cataphoresis bath and applied in succession are a primer coat of paint, a base coat of paint and optionally a varnish top coat.

Before applying the cataphoretic coating to the part, it is degreased beforehand and then phosphated so as to ensure that said coating adheres. The cataphoretic coating provides the part with additional corrosion protection. The primer coat of paint, generally applied by spray coating, prepares the final appearance of the part and protects it from stone chippings and from UV radiation. The base coat of paint gives the part its color and its final appearance. The varnish coat gives the surface of the part good mechanical strength, good resistance to aggressive chemicals and an attractive surface appearance.

The coat of paint (or paint system) used to protect the galvanized parts and to ensure an optimum surface appearance has for example a cataphoretic coating 10 to 20 μm in thickness, a primer coat of paint less than 30 μm in thickness and a base coat of paint less than 40 μm in thickness.

In cases in which the paint system further includes a varnish coat, the thicknesses of the various coats of paint are generally the following:

- cataphoretic coating: less than 10 to 20 μm;
- primer coat of paint: less than 20 μm;
- base coat of paint; less than 20 μm and advantageously less than 10 μm; and
- varnish coat: preferably less than 30 μm.

The paint system may also comprise no cataphoretic coating, and may comprise only a primer coat of paint and a base coat of paint and optionally a varnish coat.

Trials

Trials were carried out on a cold-rolled metal strip made of IF-Ti steel, which was passed through a tank containing a bath of variable composition. The bath was maintained at a temperature 70° C. above the liquidus of the composition.

Upon leaving the bath, the coating obtained was wiped with nitrogen, by means of two conventional nozzles, so as to obtain a coating thickness of around 7 μm.

The path of the steel strip between the outlet of the coating bath and the post-wiping zone was subdivided into four zones:

- a zone 1 going from the outlet of the bath up to a distance of 10 cm beneath the wiping line;
- a zone 2 going from the end of zone 1 up to the wiping line;
- a zone 3 going from the end of zone 2 up to a distance of 10 cm above the wiping line; and
- a zone 4 going from the end of zone 3 up to the point of solidification of the metal coating.

Placed in each of these zones were confinement boxes with various nitrogen-based atmospheres containing a volume fraction of oxygen as indicated in the following table, or else consisting of air. Specific sensors were used to check the oxygen content in the boxes.

Three series of specimens were taken from the sheet once it had been coated. The first series underwent no further modification, the second series was drawn in 3.5% equibiaxial strain (Marciniak) mode while the third series was firstly subjected to a skin-pass operation with a 1.5% elongation and then drawn, as in the second series.

As the trials progressed, the waviness Wa0.8 was measured. This measurement consisted in using a mechanical probe, without a slide, to determine a profile of the sheet over a length of 50 mm, measured at 45° to the rolling direction. The approximation of its general shape by a 5th-order polynomial was determined from the signal obtained. The waviness Wa was then isolated from the roughness Ra by a Gaussian filter with a 0.8 mm cutoff threshold. The results obtained are given in the following table:

| | Composition of the coating (wt %) | | | | | | | | Waviness $Wa_{0.8}$ (μm) | | | |
|---|---|---|---|---|---|---|---|---|---|---|---|---|
| Trial | Zn | Al | Mg | Si | Zone 1 (vol %) | Zone 2 (vol %) | Zone 3 (vol %) | Zone 4 (vol %) | No skin-pass or deformation | No skin-pass and after deformation | With skin-pass and before deformation | With skin-pass and after deformation |
| 1 | 92 | 8 | 0 | 0 | Air | Air | Air | Air | 0.68 | 0.61 | 0.39 | 0.67 |
| 2* | 92 | 8 | 0 | 0 | Air | Air | 3% $O_2$ | Air | 0.55 | 0.5 | 0.48 | 0.53 |
| 3 | 98 | 2 | 0 | 0 | Air | Air | Air | Air | 0.69 | 0.62 | 0.47 | 0.66 |
| 4* | 98 | 2 | 0 | 0 | Air | Air | 3% | Air | 0.6 | 0.57 | 0.47 | 0.58 |
| 5 | 85.5 | 11.5 | 3 | 0 | Air | Air | Air | Air | 0.89 | 0.82 | 0.5 | 0.84 |
| 6* | 85.5 | 11.5 | 3 | 0 | Air | Air | 3% $O_2$ | Air | 0.71 | 0.65 | 0.46 | 0.69 |
| 7 | 45 | 55 | 0 | 0 | Air | Air | Air | Air | 0.91 | 0.84 | 0.48 | 0.87 |
| 8 | 45 | 55 | 0 | 0 | Air | Air | 6% $O_2$ | Air | 0.89 | 0.87 | 0.46 | 0.89 |
| 9* | 45 | 55 | 0 | 0 | Air | Air | 3% $O_2$ | Air | 0.74 | 0.68 | 0.44 | 0.63 |
| 10 | 45 | 55 | 0 | 0 | 0.1 $O_2$ | 0.1 $O_2$ | 0.1 $O_2$ | Air | ne | ne | ne | ne |
| 11 | 0 | 80 | 0 | 20 | Air | Air | Air | Air | 0.83 | 0.73 | 0.47 | 0.77 |
| 12* | 0 | 80 | 0 | 20 | Air | Air | 3% $O_2$ | Air | 0.65 | 0.59 | 0.49 | 0.61 |
| 13 | 99.7 | 0.3 | 0 | 0 | Air | Air | Air | Air | 0.72 | 0.62 | 0.41 | 0.63 |
| 14 | 99.7 | 0.3 | 0 | 0 | Air | Air | 6% $O_2$ | Air | 0.75 | 0.67 | 0.44 | 0.72 |
| 15* | 99.7 | 0.3 | 0 | 0 | Air | Air | 3% | Air | 0.53 | 0.48 | 0.37 | 0.45 |
| 16 | 99.7 | 0.3 | 0 | 0 | 0.1 $O_2$ | 0.1 | 0.1 $O_2$ | Air | ne | ne | ne | ne |
| 17 | 95 | 5 | 0 | 0 | Air | Air | Air | Air | 1.37 | 1.14 | 0.46 | 0.93 |
| 18* | 95 | 5 | 0 | 0 | Air | Air | 3% $O_2$ | Air | 0.87 | 0.79 | 0.42 | 0.84 |

ne: not evaluated; *: according to the invention.

On examining the results of the trials, it may be clearly seen that the process is applicable to many types of coatings.

Moreover, the influence of the process on the level of waviness of the coatings obtained may also be seen. In particular, trials 1, 3, 5, 7, 11, 13 and 17 show that when the wiping atmosphere is not controlled, the waviness is not of a satisfactory level.

Trials 8 and 14 show that a wiping atmosphere with an excessively high oxygen content and therefore with an excessively high oxidizing power does not allow satisfactory levels to be achieved either, even though they are slightly better than the prior art.

Trials 10 and 16 furthermore show the necessity of maintaining a minimum oxidizing power in the confinement atmosphere and the necessity of not confining the strip above the coating bath in order to prevent zinc vaporization, which would cause unacceptable visible defects.

BRIEF DESCRIPTION OF THE FIGURES

Preferred embodiments of the present invention will be elucidated with reference to the drawings, in which.

DETAILED DESCRIPTION

Figure 3:
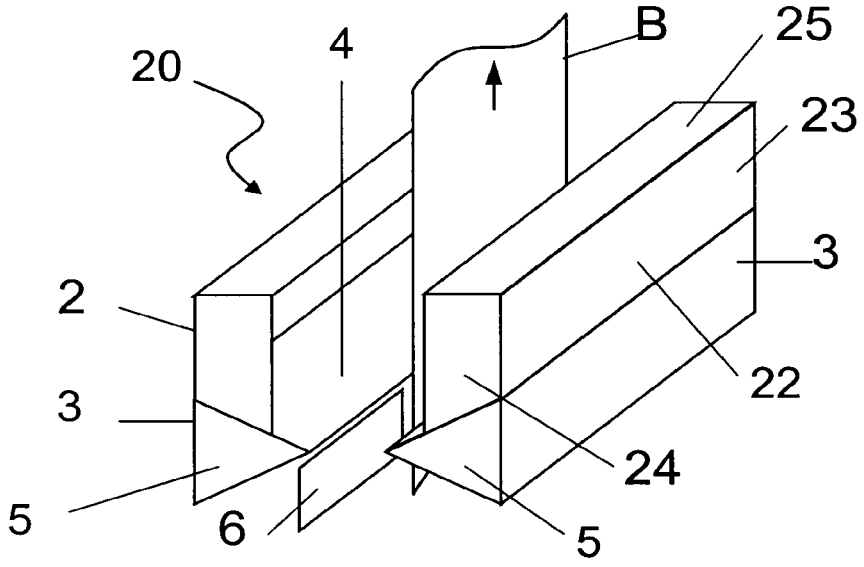
FIG. 3 is a perspective view of an embodiment of a confined wiping device according to the invention.

Referring firstly to FIG. 3, this shows a first embodiment of a confined wiping device 20 according to the invention, which comprises two identical wiping nozzles 3 placed at the same level on each side of the strip B. These wiping nozzles 3 have a triangular general shape and each consist of two longitudinal metal plates 4 and 4' (not visible) that are fixed together by means of two lateral triangular plates 5 and 5' (not depicted). The longitudinal metal plates 4 and 4' are joined together in such a way that thin slots remain between them, so as to allow the pressurized wiping gas, conveyed by means that are not depicted, to pass through it.

The confined wiping device 20 also includes two confinement boxes 21 and 22 which are each placed on the upper external faces of each nozzle 3, said spaces being formed from upper metal plates 4, and are welded to said plates. The box 22 consists of the assembly of two lateral plates 24 and an upper part consisting of a horizontal plate 25 and a vertical plate 23. The plates 24 and 25 preferably have the same width, which may be equal to or smaller than the depth of the nozzle 3.

The box 21 is identical in all points to the box 22.

Finally, the confined wiping device 20 includes two metal plates 6, called "antinoise baffles", the function of which is to prevent the wiping gas streams emanating from each nozzle 3 meeting one another in the lateral zones where the strip B is not present. In this way, strips of variable width can run through the same coating installation, and the interposition of such plates 6 is useful, especially for preventing sound vibrations of very large amplitude from being generated.

Figure 4:
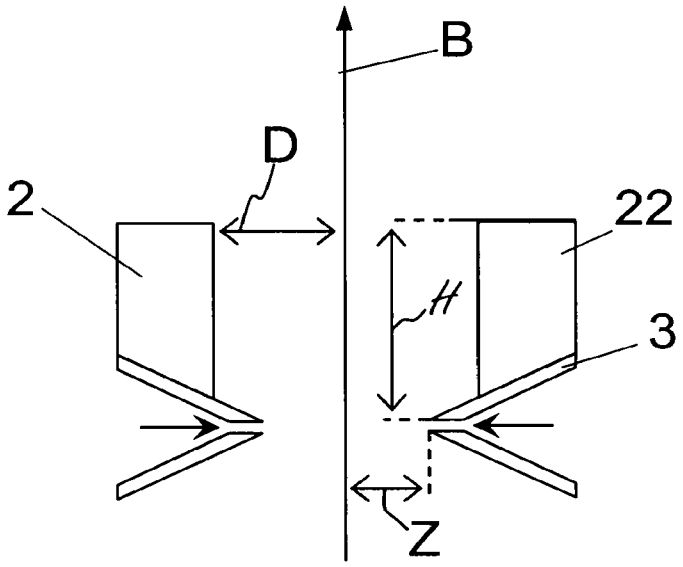
FIG. 4 is a sectional view of the device of FIG. 3.

Turning now to FIG. 4, this shows a sectional view of the device of FIG. 3, in which the two wiping nozzles 3 are depicted, an arrow indicating the stream of wiping gas on each side of the strip. The height of the confinement boxes 21 and 22, depicted by the letter H, is measured between the wiping line and the upper part of the boxes. In the process according to the invention, this height has to be at least 10 cm in order to obtain satisfactory results in terms of waviness.

The distance D separating the boxes 21 and 22 from the strip B varies according to the width of the lateral and upper plates 24 and 25. On completing the various trials, the present inventors have demonstrated that a distance D between 10 and 100 mm allows the wiping gas to be satisfactorily extracted, while still remaining sufficiently far from the path of the strip B in order to avoid any contact therewith.

The distance Z between the end of the nozzles 3 and the strip B is preferably between 3 and 25 mm, as is conventional.

Figure 1:
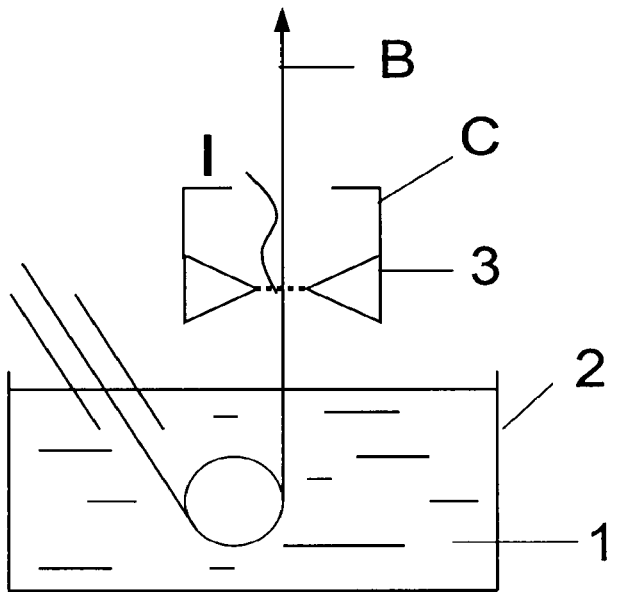
FIG. 1 shows an embodiment of a confined wiping device according to the invention.
Figure 2:
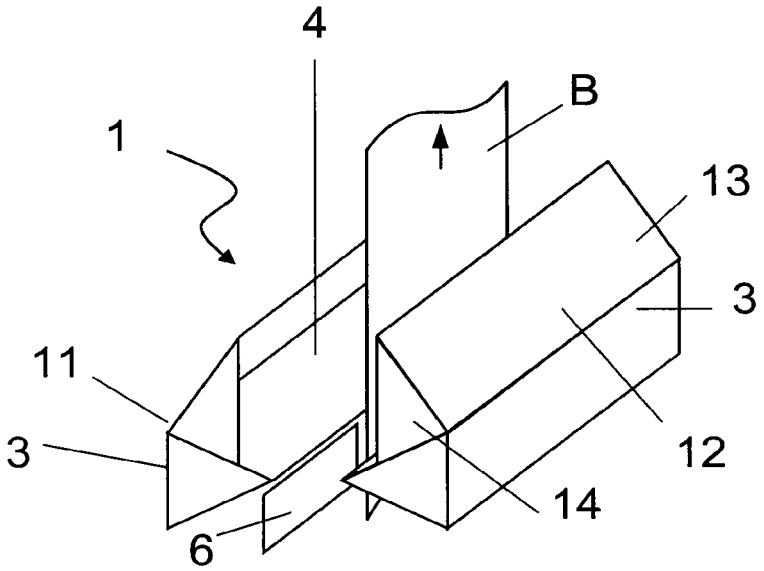
FIG. 2 is a perspective view of an embodiment of a confined wiping device according to the invention.

Turning now to FIG. 2, this shows another embodiment of a confined wiping device 10 according to the invention. As previously, this device includes wiping nozzles 3 identical to those described in the case of FIG. 3 and antinoise plates 6.

It further includes two confinement boxes 11 and 12 placed on and fixed to the upper face 4 of the wiping nozzles 3. The box 12 comprises an inclined upper plate 13 joined to two triangular lateral plates 14. The box 11 is identical to the box 12.

As for the boxes in FIG. 3, the boxes 11 and 12 have a width which may in the maximum case be equal to the depth of the nozzles 3.

In this embodiment, the height H of the confinement boxes 11 and 12 is measured between the wiping line and the upper edge of the plates 13.

This embodiment has in particular the advantage of enclosing a smaller volume than that in FIG. 3, thereby making it easier to control the confinement atmosphere and enabling a smaller amount of inerting gas to be consumed when it is necessary to supply such a gas.

Figure 5:
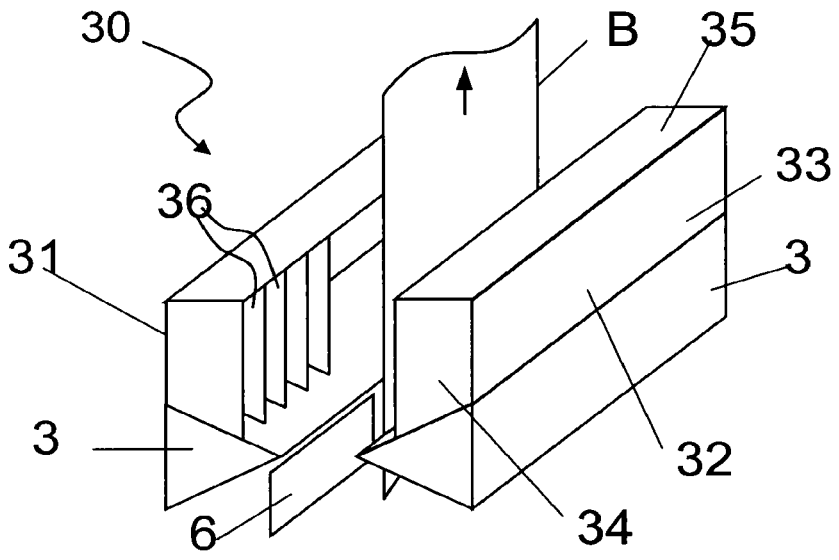
FIG. 5 is a perspective view of an embodiment of a confined wiping device according to the invention.

Referring now to FIG. 5, this shows another embodiment of a confined wiping device 30 according to the invention. It is overall identical to the device 20 of FIG. 3 and in particular comprises two confinement boxes 31 and 32 comprising an upper part consisting of vertical plates 33 joined to horizontal plates 35, and lateral parts 34. Each of the boxes 31 and 32 is also compartmentalized by a series of vertical blades 36 extending from the upper face of the wiping nozzle 3 up to the upper part 35 of the confinement boxes 31 and 32.

This particular arrangement has the advantage of limiting the ingress of oxygen into the confinement boxes 31 and 32.

Figure 6:
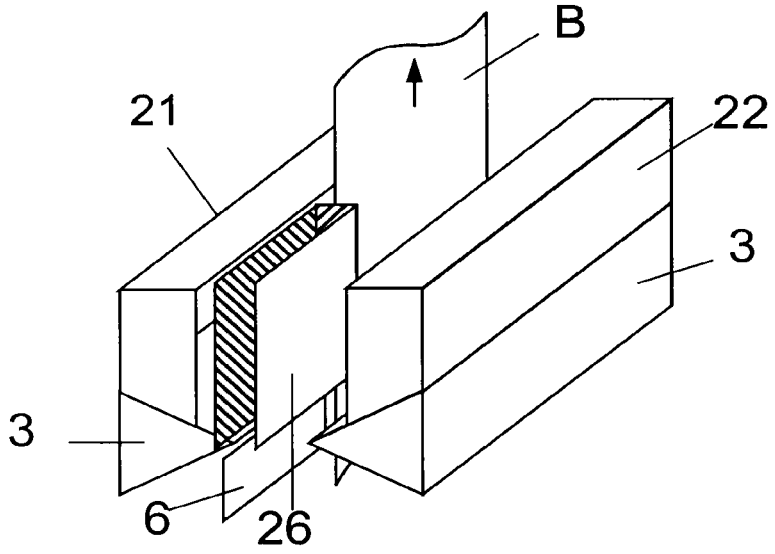
FIG. 6 is a perspective view of an embodiment of a confined wiping device according to the invention.

FIG. 6 shows another embodiment of a confinement device according to the invention similar to that shown in FIG. 3, but further including edge confinement pieces 26 placed between the confinement boxes 21 and 22, above the antinoise plates 6 and facing the edges of the strip B. As their name indicates, these pieces have the function of further confining the atmosphere surrounding the strip B along its edges.

In a preferred embodiment, these edge confinement pieces may be moved horizontally and vertically in order to adapt to the various formats of strip to be coated.

In the embodiment shown in FIG. 6, the edge confinement piece 26 consists of two rectangular plates parallel to the strip B and joined by a lateral plate placed facing the edges of the strip B.

Figure 7:
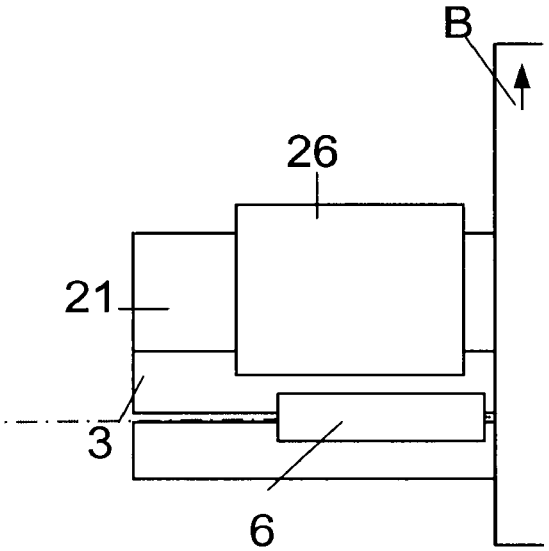
FIG. 7 is a sectional view of the device of FIG. 6.

FIG. 7 shows the relative position of the confinement piece 26 above the antinoise plate 6.

Figure 8:
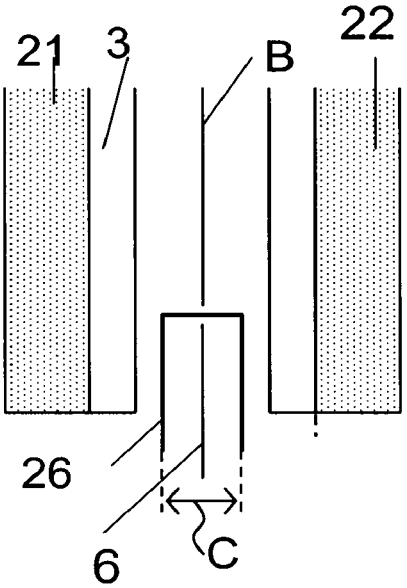
FIG. 8 is a top view of the device of FIG. 6.

As illustrated in FIG. 8, the width C of the lateral plate can vary depending on the extent of edge confinement desired.

Figure 9:
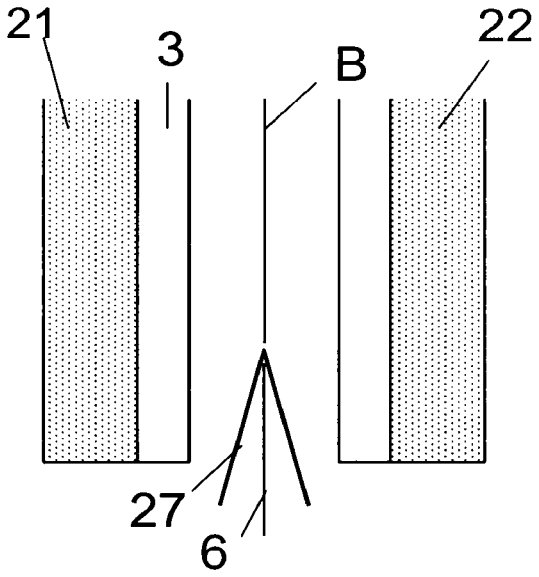
FIG. 9 is a bottom view of an embodiment of a confined wiping device according to the invention.

FIG. 9 shows another embodiment of the confinement pieces according to the invention. The piece 27 consists of two rectangular plates inclined to the plane in which the strip B runs and joined along their vertical edge facing the edges of the strip B.

This embodiment has the advantage of limiting the ingress of oxygen even more than the design shown in FIG. 6. The inclined positioning of the two rectangular plates promotes gas flow from the inside of the box toward the outside and discourages gas flow from the outside toward the interior of the box.

Figure 10:
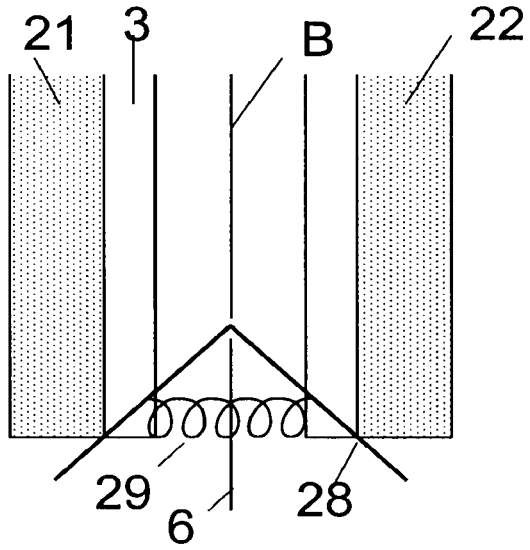
FIG. 10 is a top view of an embodiment of a confined wiping device according to the invention.

FIG. 10 shows another embodiment of the confinement pieces according to the invention in which the confinement piece 28 further includes a return means 29, here taking the form of a spring, joining the inclined rectangular plates together. These plates are inclined to the plane in which the strip B runs so as to be in contact with the lateral parts of the confinement boxes 21 and 22.

The edge confinement pieces described above are placed on top of the antinoise plates 6. However, it is possible to extend them as far as the outlet orifices of the wiping nozzles in order to give them an antinoise plate function, making the use of such plates pointless.

What is claimed is:

1. An installation for the continuous hot-dip coating of metal strip, comprising:

a tank containing a bath of molten metal;

a metal strip running through the bath; and a confined wiping device comprising:

a respective wiping nozzle placed on each side of a path of the strip after the strip has left the bath of molten metal, each wiping nozzle having at least one gas outlet orifice and an upper face; and a respective confinement box located adjacent the upper face of each wiping nozzle, wherein the confinement boxes open on a face which faces the strip, each confinement box including an upper part including a vertical plate and a horizontal plate, each confinement box further including two lateral parts, wherein each confinement box further includes a plurality of vertical blades extending from the upper face of the adjacent wiping nozzle up to the horizontal plate of the upper part of said each confinement box, said plurality of vertical blades located between the two lateral parts of said each confinement box, the vertical and horizontal plates extending continuously between the two lateral parts, wherein each confinement box consists of the vertical plate, the horizontal plate, the two lateral parts, and the plurality of vertical blades.

2. The installation as recited in claim 1, wherein, in each confinement box, a width of the horizontal plate is equal to a width of each lateral part.

3. The installation as recited in claim 2, wherein the width of the horizontal plate and the width of each lateral part is less than or equal to a depth of the wiping nozzles.

4. The installation as recited in claim 2, wherein a height H of the confinement boxes in relation to a wiping line is greater than or equal to 10 cm.

5. The installation as recited in claim 1, wherein each of the wiping nozzles has a triangular general shape defined by two longitudinal plates fixed together by two triangular end plates.

6. The installation as recited in claim 1, wherein a distance D between an end of the lateral parts of the confinement boxes and the strip is from 10 to 100 mm.

7. The installation as recited in claim 1, wherein a height H of the confinement boxes in relation to a wiping line is greater than or equal to 10 cm.

8. The installation as recited in claim 1, wherein the confined wiping devices further include anti-noise plates on each side of the strip, facing part of the outlet orifice of the wiping nozzles.

9. The installation as recited in claim 8, further comprising edge confinement pieces placed between the confinement boxes above the anti-noise plates, facing edges of the strip.

10. The installation as recited in claim 9, wherein the edge confinement pieces may be moved horizontally and vertically.

11. The installation as recited in claim 9, wherein each of the edge confinement pieces includes two rectangular plates parallel to the strip and are connected by a lateral plate placed facing the edges of the strip.

12. The installation as recited in claim 9, wherein each of the edge confinement pieces includes two rectangular plates inclined to a plane in which the strip runs and joined together along a vertical edge, the vertical edges placed facing the edges of the strip.

13. The installation as recited in claim 1, further comprising a supply of wiping gas connected to the gas outlet orifice of each nozzle, wherein said wiping gas has an oxidizing power lower than that of an atmosphere consisting of 4% oxygen by volume and 96% nitrogen by volume and wherein the confinement box has an atmosphere with an oxidizing power lower than that of an atmosphere consisting of 4% oxygen by volume and 96% nitrogen by volume and higher than that of an atmosphere consisting of 0.15% oxygen by volume and 99.85% nitrogen by volume.

14. The installation as recited in claim 1, wherein the wiping nozzles include a single outlet orifice in a form of a longitudinal slot with a width at least equal to that of the strip to be coated.

15. The installation as recited in claim 1, wherein gas supplied to the confinement box is supplied only from the gas outlet orifice.

16. The installation as recited in claim 1, wherein the vertical blades define vertical passages extending from the upper face of the wiping nozzle up to the horizontal plate.

17. The installation as recited in claim 1, wherein each confinement box is supplied with an inert gas.

18. A confined wiping device comprising:

a respective wiping nozzle placed on each side of a path of a strip after the strip has left a bath of molten metal, each wiping nozzle having at least one gas outlet orifice and an upper face; and a respective confinement box located adjacent the upper face of each wiping nozzle, the confinement boxes open on a face which faces the strip, each confinement box including an upper part including a vertical plate and a horizontal plate, each confinement box further including two lateral parts, wherein each of the confinement boxes further includes a plurality of vertical blades extending from the upper face of the adjacent wiping nozzle up to the horizontal plate of the upper part of said each confinement box, said plurality of vertical blades located between the two lateral parts of said each confinement box, the vertical and horizontal plates extending continuously between the two lateral parts, wherein each confinement box consists of the vertical plate, the horizontal plate, the two lateral parts, and the plurality of vertical blades.

19. The device as recited in claim 18, wherein, in each confinement box, a width of the horizontal plate is equal to a width of each lateral part.

20. The device as recited in claim 19, wherein the width of the horizontal plate and the width of each lateral part is less than or equal to a depth of the wiping nozzles.

21. The device as recited in claim 18, wherein each of the wiping nozzles has a triangular general shape defined by two longitudinal plates fixed together by two triangular end plates.

22. The device as recited in claim 18, wherein a distance D between an end of the lateral parts of the confinement boxes and the strip is from 10 to 100 mm.

23. The device as recited in claim 18, further comprising a supply of wiping gas connected to the gas outlet orifice of each nozzle, wherein said wiping gas has an oxidizing power lower than that of an atmosphere consisting of 4% oxygen by volume and 96% nitrogen by volume and wherein the confinement box has an atmosphere with an oxidizing power lower than that of an atmosphere consisting of 4% oxygen by volume and 96% nitrogen by volume and higher than that of an atmosphere consisting of 0.15% oxygen by volume and 99.85% nitrogen by volume.

24. The device as recited in claim 18, wherein gas supplied to the confinement box is supplied only from the gas outlet orifice.

25. The device as recited in claim 18, wherein the vertical blades define vertical passages extending from the upper face of the wiping nozzle up to the horizontal plate.

26. The device as recited in claim 18, wherein each confinement box is supplied with an inert gas.

* * * * *